United States Patent [19]

Rehberg

[11] Patent Number: 5,073,227

[45] Date of Patent: Dec. 17, 1991

[54] MOISTENING DEVICE FOR ENVELOPE FLAPS

[75] Inventor: Heinz Rehberg, Berlin, Fed. Rep. of Germany

[73] Assignee: Francotyp-Postalia GmbH, Berlin, Fed. Rep. of Germany

[21] Appl. No.: 568,422

[22] Filed: Aug. 16, 1990

[30] Foreign Application Priority Data

Aug. 23, 1989 [DE] Fed. Rep. of Germany ..... 3928307

[51] Int. Cl.[5] ..... B43M 1/00

[52] U.S. Cl. ..... 156/441.5; 156/442; 118/264

[58] Field of Search ..... 156/441.5, 442, 284, 156/DIG. 35, DIG. 50, 442.1, 442.2, 442.3, 442.4; 118/264, 268, 265, 243

[56] References Cited

U.S. PATENT DOCUMENTS 603,768 5/1898 Karges ..... 118/268
2,944,511 7/1960 Bach et al. ..... 156/442.1
3,359,896 12/1967 Leibbrand .

FOREIGN PATENT DOCUMENTS 104276 12/1897 Fed. Rep. of Germany .
1561881 4/1970 Fed. Rep. of Germany .
1511420 9/1975 Fed. Rep. of Germany .
3337488 5/1986 Fed. Rep. of Germany .

*Primary Examiner*—David A. Simmons
*Assistant Examiner*—James J. Engel, Jr.
*Attorney, Agent, or Firm*—Herbert L. Lerner; Laurence A. Greenberg

[57] ABSTRACT

A moistening device for the application of a liquid to gummed surfaces of envelope or letter flaps includes a reservoir for liquid. A sponge is disposed on a support. A brush holder is resiliently disposed above the reservoir. A brush is held by the brush holder and has bristles resting on the sponge for soaking with the liquid. An absorptive strip is disposed above the brush for storage of the liquid.

5 Claims, 1 Drawing Sheet

MOISTENING DEVICE FOR ENVELOPE FLAPS

Figure 1:
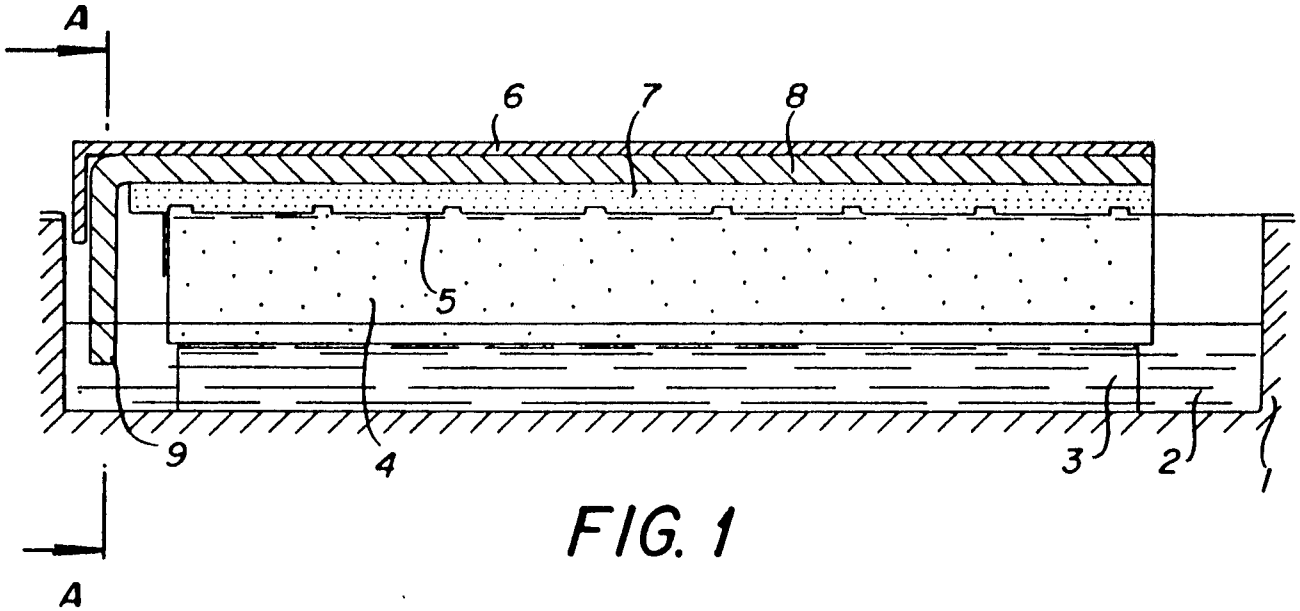

The invention relates to a moistening device for the application of a liquid to the gummed surfaces of envelope or letter flaps by means of brushes.

For the purpose of automatically sealing envelopes, the gummed flap of the envelope is guided across a moistening device, which prepares the gummed area of the flap by moistening or softening the glue. Subsequent pressing down of the flap seals the envelope. A moistening strip extending out of a reservoir for liquid is used in order to provide moistening and the envelope flap is drawn over the moistening strip as in German Patent DE-PS 15 11 420, or a brush is wetted by suitable means as in German Published, Prosecuted Application DE-AS 15 61 881 and German Patent DE-PS 33 37 488. When using brushes, the bristles of the brush generally rest on pads, sponges or rollers that are soaked in liquid, so as to resorb the liquid and give it off again to the bristles of the brush in the interval between two passing envelopes. The liquid reaches the gummed portion of the envelope flap from the bristles of the brush. However, the liquid retention of a brush is relatively small. Furthermore, the time for absorbing liquid through pads, sponges or rollers is shortened when using a high flow speed of the envelopes. When moistening the flaps of larger envelopes sizes and in particular flaps to be closed along the longer edge of the envelope, such a procedure leads to partial moistening and thus to incomplete closure.

It is accordingly an object of the invention to provide a moistening device for envelope flaps applying moisture by means of brushes, which overcomes the hereinafore-mentioned disadvantages of the heretofore-known devices of this general type and which continuously assures a sufficient supply of liquid on the brush, even with a high flow speed.

With the foregoing and other objects in view there is provided, in accordance with the invention, a moistening device for the application of a liquid to gummed surfaces of envelope or letter flaps, comprising a reservoir for liquid, a support, a sponge disposed on the support, a brush holder resiliently disposed above the reservoir, a brush being held by the brush holder and having bristles resting on the sponge for soaking with the liquid, and an absorptive strip disposed above the brush for storage of the liquid.

In accordance with another feature of the invention, the absorptive strip has an angled end continuously dipped into the liquid for accommodating a large flow rate or speed of envelopes or letters.

In accordance with a further feature of the invention, the sponge and the absorptive strip are formed of porous material.

In accordance with an added feature of the invention, the sponge and the absorptive strip are formed of the same material.

In accordance with a concomitant feature of the invention, the sponge and the absorptive strip are formed of different materials.

Although the invention is illustrated and described herein as embodied in a moistening device for envelope flaps, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
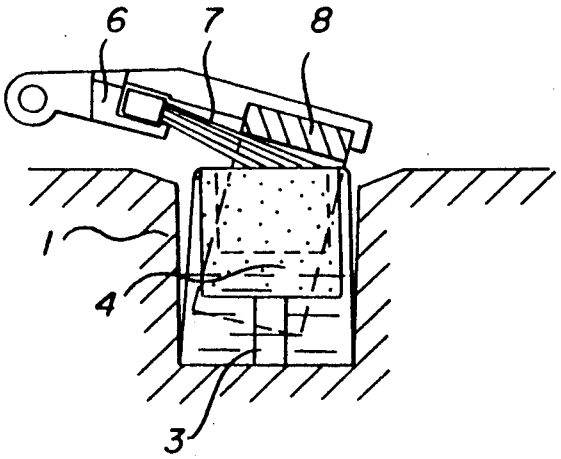

FIG. 1 is a fragmentary, diagrammatic, sectional view of a moistening device in which envelope or letter flaps to be moistened move towards the viewer, for example; and FIG. 2 is a fragmentary section view taken along the line A—A of FIG. 1, in the direction of the arrows.

Referring now in detail to the figures of the drawings as a whole in which like parts have the same reference numerals, there is seen a moistening device formed of a reservoir 1 for a liquid, a liquid 2 received in the reservoir and a sponge 4 on a support 3. Use of a support 3 assures the presence of a supply of liquid which has not been absorbed. The sponge 4 is fixed in its position by means of a holder 5.

A brush holder 6 is resiliently supported above the reservoir or container 1 and holds a brush 7 and an absorptive strip 8 extending over the length of the brush 7. The bristles of the brush 7 rest on the sponge 4 and take up liquid from it as long as no envelope or letter flap is passed between the brush 7 and the holder 5 for moistening. The absorptive strip 8 has an angled end 9 which is always disposed in the liquid 2. In this way, the brush 7 is continuously supplied with liquid, regardless of the flow rate and the possible swift succession of the envelopes to be closed or letters to be sealed.

The amount of liquid on the brush 7 may be too great for a smaller amount of envelopes to be closed or letters to be sealed which pass through, or for smaller sizes or poorer qualities of paper, such as recycled paper. In such a case an absorptive strip 8 is used which does not have an end that dips into the liquid In this case the absorptive strip 8 is used as a reservoir for the liquid. As in the previously described cases, the liquid itself is absorbed directly from the sponge 4 by the brush bristles and a portion is transferred to the absorptive strip 8.

A porous material, such as felt, fleece or foam material with large pores, is used as the material for the sponge 4 and the absorptive strip 8. It is possible to use different materials for the sponge 4 and the absorptive strip 8, depending on whether it is to be used for quick or slower passage.

I claim:

1. Moistening device for the application of a liquid to gummed surfaces of envelope or letter flaps, comprising a reservoir for liquid, a support, a sponge disposed on said support, a brush holder resiliently disposed above said reservoir, a brush being held by said brush holder and having bristles resting on said sponge for soaking with the liquid, and an absorptive strip disposed above said brush for storage of the liquid.

2. Moistening device according to claim 1, wherein said absorptive strip has an angled end continuously dipped into the liquid for accommodating a large flow speed of envelopes or letters.

3. Moistening device according to claim 1, wherein said sponge and said absorptive strip are formed of porous material.

4. Moistening device according to claim 3, wherein said sponge and said absorptive strip are formed of the same material.

5. Moistening device according to claim 3, wherein said sponge and said absorptive strip are formed of different materials.

* * * * *